US008054273B2

(12) United States Patent
Tanaka

(10) Patent No.: US 8,054,273 B2
(45) Date of Patent: Nov. 8, 2011

(54) ELECTRO-OPTICAL DEVICE

(75) Inventor: Toshihiko Tanaka, Tottori (JP)

(73) Assignee: Sony Corporation, Tokyo (JP)

( * ) Notice: Subject to any disclaimer, the term of this patent is extended or adjusted under 35 U.S.C. 154(b) by 425 days.

(21) Appl. No.: 12/428,783

(22) Filed: Apr. 23, 2009

(65) Prior Publication Data

US 2009/0278778 A1 Nov. 12, 2009

(30) Foreign Application Priority Data

May 7, 2008 (JP) ..... 2008-120866

(51) Int. Cl.
*G09G 3/36* (2006.01)

(52) U.S. Cl. ..... 345/94; 345/204

(58) Field of Classification Search ..... 345/53, 345/87, 92, 94, 204; 359/245; 348/790
See application file for complete search history.

(56) References Cited

U.S. PATENT DOCUMENTS 7,928,941 B2 * 4/2011 Yamazaki et al. ..... 345/84
2001/0026259 A1 10/2001 McKnight
2007/0018919 A1 1/2007 Zavracky et al.

FOREIGN PATENT DOCUMENTS

JP A-2002-350810 12/2002

* cited by examiner

*Primary Examiner* — Abbas Abdulselam
(74) *Attorney, Agent, or Firm* — K&L Gates LLP

(57) ABSTRACT

Provided is an electro-optical device including: a display unit including a plurality of display areas in which pixels are arranged; common electrodes provided in correspondence with the plurality of display areas; pixel electrodes provided in correspondence with the pixels and facing the common electrodes with an electro-optical material interposed therebetween; a driving control unit which controls writing of an image signal to the pixel electrode in each of the plurality of display areas; and a voltage applying control unit which controls applying of a predetermined voltage to the common electrode in each of the plurality of display areas; wherein the driving control unit is configured to stop the writing of the image signal to the pixel electrode during a predetermined period in a period close to at least one of a start time point or an end time point of the applying of the predetermined voltage, when the predetermined voltage is applied to the common electrode of the display area adjacent to one display area by the voltage applying control unit during a period in which the image signal is written to the pixel electrode in one of the plurality of display areas.

11 Claims, 6 Drawing Sheets

ELECTRO-OPTICAL DEVICE

BACKGROUND

1. Technical Field

The present invention relates to an electro-optical device.

2. Related Art

As an example of an electro-optical device (liquid crystal display device), a liquid crystal display device for performing field sequential driving such that a plurality of light sources sequentially emits light is known. In the field sequential driving, writing of image signals corresponding to red, green and blue and light emission of light sources of red, green and blue are sequentially performed such that the images of the unit colors of red, green and blue overlap with each other so as to display a color image. Meanwhile, in the field sequential driving, since the light sources of red, green and blue sequentially emit light, the liquid crystal display device needs to be operated at a high speed. However, since the light sources cannot emit light until the image signals are written to all pixels and liquid crystal responds thereto, it is difficult to operate the liquid crystal display device at the high speed. Accordingly, when a display area in which the pixels are arranged is divided into a plurality of areas and the writing of the image signals and the light emission of the light sources are performed for each of the plurality of areas, the light emission of the light sources may not be awaited until the image signals are written to all the pixels. Therefore, it is possible to operate the liquid crystal display device at the high speed. However, in the liquid crystal display device, since a previous image is continuously displayed until the display is switched, a moving image blurs. In order to reduce the blurring of this moving image, a method of inserting a black display screen between a frame (a period for displaying one image) and a frame is suggested (for example, see JP-A-2002-350810). In JP-A-2002-350810, a potential necessary for the black display are generated in a pixel electrode due to capacitive coupling generated by varying a voltage applied to an auxiliary capacitive line included in each of the pixels.

However, when the liquid crystal display device described in JP-A-2002-350810 in which the black display screen is inserted between the frame and the frame is applied to the liquid crystal display device in which the display area is divided into the plurality of areas and the writing of the image signals and the light emission of the light sources are performed for each of the plurality of areas, since the applying of the voltage to the liquid crystal for performing the black display and the writing of the image signals are performed in parallel, the image signals may be distorted by the capacitive coupling due to the voltage applied to the liquid crystal in order to perform the black display. Therefore, the quality of the displayed image deteriorates.

SUMMARY

An advantage of some aspects of the invention is that it provides an electro-optical device such as a liquid crystal display device capable of suppressing the deterioration of the quality of a display image.

According to a first aspect of the invention, there is provided an electro-optical device including: a display unit including a plurality of display areas in which pixels are arranged; common electrodes provided in correspondence with the plurality of display areas; pixel electrodes provided in correspondence with the pixels and facing the common electrodes with an electro-optical material interposed therebetween; a driving control unit which controls writing of an image signal to the pixel electrode in each of the plurality of display areas; and a voltage applying control unit which controls applying of a predetermined voltage to the common electrode in each of the plurality of display areas; wherein the driving control unit is configured to stop the writing of the image signal to the pixel electrode during a predetermined period in a period close to at least one of a start time point or an end time point of the applying of the predetermined voltage, when the predetermined voltage is applied to the common electrode of the display area adjacent to one display area by the voltage applying control unit during a period in which the image signal is written to the pixel electrode in one of the plurality of display areas.

In the electro-optical device according to the first aspect of the invention, as described above, since the display unit includes the plurality of display areas, unlike the case where the light sources emit lights after the image signals are written to all the pixel electrodes of the display unit, the light sources can emit lights at time points when the writing of the image signals to the pixel electrodes of the display areas is completed and the response of the liquid crystal which is the electro-optical material is completed. Therefore, the writing of the image signals to all the pixel electrodes of the display unit may not be awaited and thus the electro-optical device can be operated at a high speed. When the predetermined voltage is equal to or greater than a voltage necessary for black display of the pixel by applying the predetermined voltage to the common electrode of the pixel, it is possible to perform the black display in the pixel. Accordingly, since the black display (black insertion) can be performed between the image which is previously displayed and the image which is newly displayed, it is possible to suppress the blurring of a moving image or the like. By stopping the writing of the image signal to the pixel during the predetermined period in the period close to at least one of the start time point or the end time point of the applying of the predetermined voltage to the common electrode of the pixel, although capacitive coupling due to the applying of the predetermined voltage between the data line and the common electrode is generated, a potential variation of the data line due to the capacitive coupling during the predetermined period in which the writing of the image signal from the data line to the pixel electrode is stopped is recovered. Accordingly, it is possible to suppress the writing of a distorted image signal from the data line to the pixel electrode and to suppress the deterioration of the quality of the displayed image. In addition, the common electrode of the pixel is provided in each of the plurality of display areas of the display unit. By this configuration, since the predetermined voltage can be applied to the common electrode in each of the display areas, it is possible to perform the black display in each of the plurality of display areas, The electro-optical device according to the first aspect of the invention may further include auxiliary capacitive electrodes provided in correspondence with the pixel electrodes, and the driving control unit may be configured to apply the predetermined voltage to the common electrode of the display area and to apply the predetermined voltage to the auxiliary capacitive line. By this configuration, although the capacitive coupling due to the applying of the predetermined voltage between the data line and the auxiliary capacitive electrode is generated, the writing of the image signal from the data line to the pixel electrode is stopped during the predetermined period. Therefore, the potential variation of the data line due to the capacitive coupling during the predetermined period is recovered.

In the electro-optical device according to the first aspect of the invention, the stop of the writing of the image signal to the pixel electrode during the predetermined period may be performed in periods close to both the start time point and the end time point of the applying of the predetermined voltage. By this configuration, it is possible to further suppress the writing of the distorted image signal from the data line to the pixel, compared with the case where the stop of the writing of the image signal to the pixel electrode during the predetermined period is performed in the vicinity of one of the start time point or the end time point of the applying of the predetermined voltage.

In the electro-optical device according to the first aspect of the invention, in the display area, the pixels may be arranged in a matrix, and the predetermined period may be a period equal to or greater than at least two horizontal scanning periods in which the plurality of pixels arranged in the matrix are scanned. By this configuration, it is possible to reduce the potential variation of the data line due to the capacitive coupling due to the predetermined voltage generated between the data line and at least one of the common electrode or the auxiliary capacitive line with certainty.

In the electro-optical device according to the first aspect of the invention, in one of the plurality of display areas, black display may be performed in the pixel by applying the predetermined voltage to at least one of the common electrode or the auxiliary capacitive line and, in the display area adjacent to one display area in which the black display (black insertion) is performed, the writing of the image signal to the pixel electrode may be stopped during the predetermined period in the period close to at least one of the start time point or the end time point of the black display (black insertion). By this configuration, since the black display (black insertion) can be performed between the image which is previously displayed and the image which is newly displayed, it is possible to suppress the blurring of a moving image or the like and to suppress the writing of the distorted image signal from the data line to the pixel due to the black display.

In the liquid crystal display device according to the first aspect of the invention, the driving control unit may write the image signal to the pixel electrode on the basis of a clock signal and stop the clock signal to the driving control unit in the predetermined period. By this configuration, it is possible to easily suppress the writing of the image signal to the pixels during the predetermined period.

In the electro-optical device according to the first aspect of the invention, a clock stop signal for stopping the writing of the image signal by the clock signal may be further included. By this configuration, it is possible to easily stop the generation of the clock signal.

In the electro-optical device, a dummy image signal may be supplied to a data line in the predetermined period in which the writing of the image signal is stopped, In the electro-optical device according to the first aspect of the invention, the electro-optical material may be liquid crystal, and may be driven by a liquid crystal mode which becomes bend alignment in which constituent molecules are arranged in a bow form, after a phase transition voltage is applied to the liquid crystal. By this configuration, since the variation of the alignment of the liquid crystal molecules are accelerated by the bending of the bow, it is possible to configure the electro-optical device with a high response speed.

In the electro-optical device according to the first aspect of the invention, the plurality of display areas may respectively include light sources which time-divisionally emit lights of three colors of red, green and blue, three colors of red, green and yellow, or four colors of red, green, yellow and orange. By this configuration, it is possible to easily display a color image by additive color mixture of lights of red, green and blue, red, green and yellow, or red, green, yellow and orange.

In the liquid crystal display device according to the first aspect of the invention, the plurality of display areas may include three or more display areas. By this configuration, since the respective light sources corresponding to the display areas can emit lights at their timings after the image signals are written and the response of the liquid crystal is awaited in the three or more display areas, the writing of the image signals to all the pixels of the display unit may not be awaited, unlike the case where the light sources emit lights after the image signals are written to all the pixels and the response of the liquid crystal is awaited. Therefore, the liquid crystal display device can be operated at a high speed.

According to a second aspect of the invention, there is provided an electro-optical device including: a display unit including a plurality of display areas in which pixels are arranged; common electrodes provided in correspondence with the plurality of display areas; pixel electrodes provided in correspondence with the pixels and facing the common electrodes with an electro-optical material interposed therebetween; auxiliary capacitive electrodes provided in correspondence with the pixel electrodes; a driving control unit which controls writing of an image signal to the pixel electrode in each of the plurality of display areas; and a voltage applying control unit which controls applying of a predetermined voltage to the auxiliary capacitive electrode in each of the plurality of display areas, wherein the driving control unit is configured to stop the writing of the image signal to the pixel electrode during a predetermined period in a period close to at least one of a start time point or an end time point of the applying of the predetermined voltage, when the predetermined voltage is applied to the auxiliary capacitive electrode of the display area adjacent to one display area by the voltage applying control unit during a period in which the image signal is written to the pixel electrode in one of the plurality of display areas.

In the electro-optical device according to the second aspect of the invention, as described above, since the display unit includes the plurality of display areas, unlike the case where the light sources emit lights after the image signals are written to all the pixel electrodes of the display unit, the light sources can emit lights at time points when the writing of the image signals to the pixel electrodes of the display areas is completed and the response of the liquid crystal which is the electro-optical material is completed. Therefore, the writing of the image signals to all the pixel electrodes of the display unit may not be awaited and thus the electro-optical device can be operated at a high speed. When the predetermined voltage is equal to or greater than a voltage necessary for black display of the pixel by applying the predetermined voltage to the auxiliary capacitive electrode of the pixel, it is possible to perform the black display in the pixel. Accordingly, since the black display (black insertion) can be performed between the image which is previously displayed and the image which is newly displayed, it is possible to suppress the blurring of a moving image or the like. By stopping the writing of the image signal to the pixel electrode during the predetermined period in the period close to at least one of the start time point or the end time point of the applying of the predetermined voltage to the auxiliary capacitive electrode of the pixel, although capacitive coupling due to the applying of the predetermined voltage between the data line and the auxiliary capacitive electrode is generated, a potential variation of the data line due to the capacitive coupling during the predetermined period in which the writing of the image signal from the data line to the pixel electrode is stopped is recovered. Accordingly, it is possible to suppress the writing of a distorted image signal from the data line to the pixel electrode and to suppress the deterioration of the quality of the displayed image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiment of the invention will be described with reference to the accompanying drawings.

Figure 1:
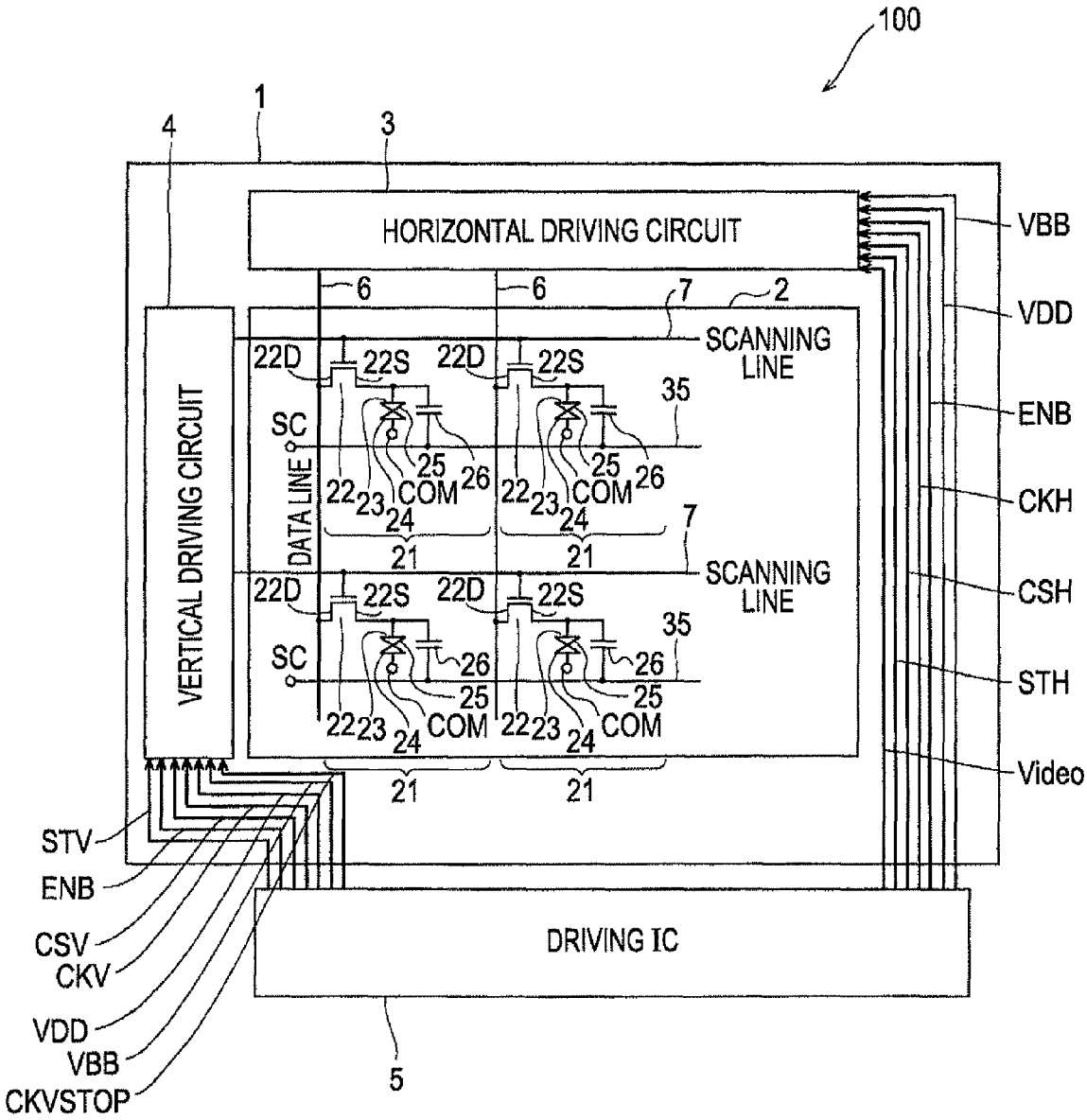
FIG. 1 is a plan view of a liquid crystal display device according to an embodiment of the invention.
Figure 2:
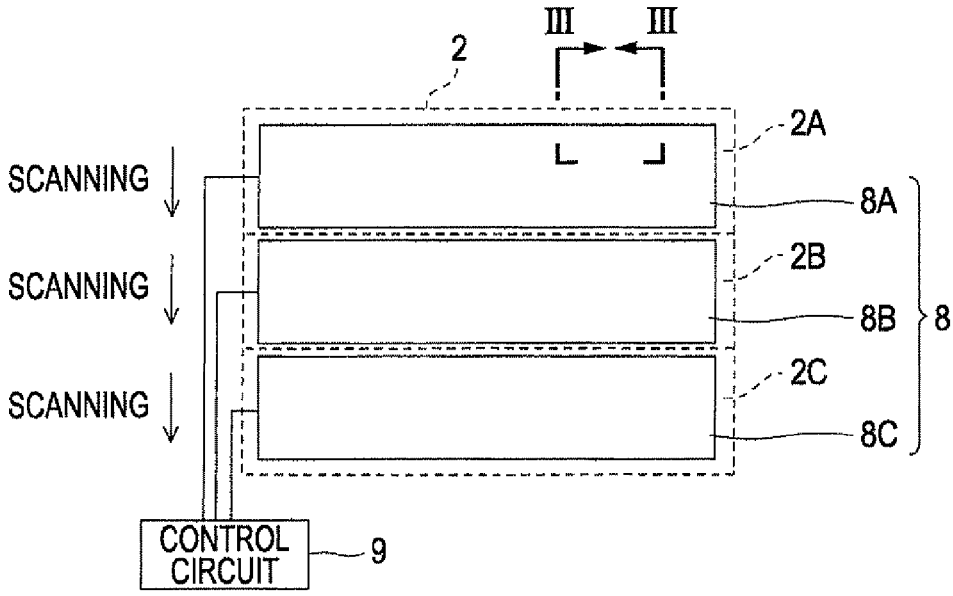
FIG. 2 is a plan view of a display unit according to the embodiment of the invention.
Figure 3:
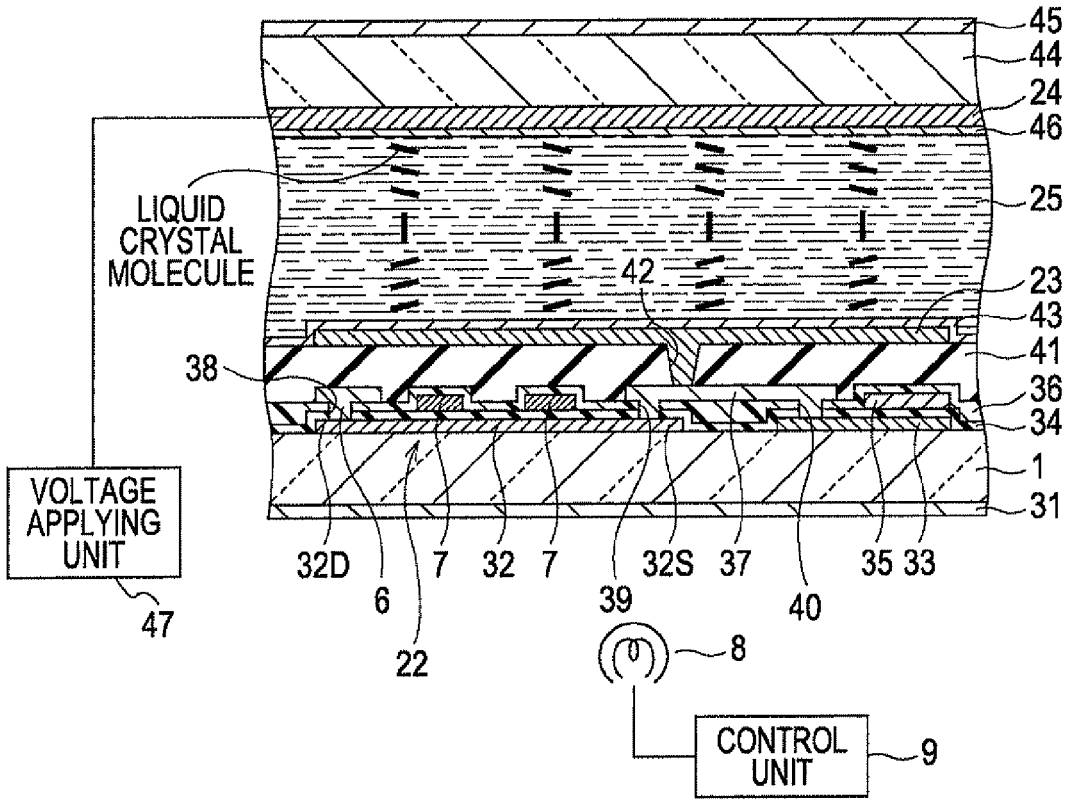
FIG. 3 is a cross-sectional view taken along line III-III of FIG. 2.
Figure 4:
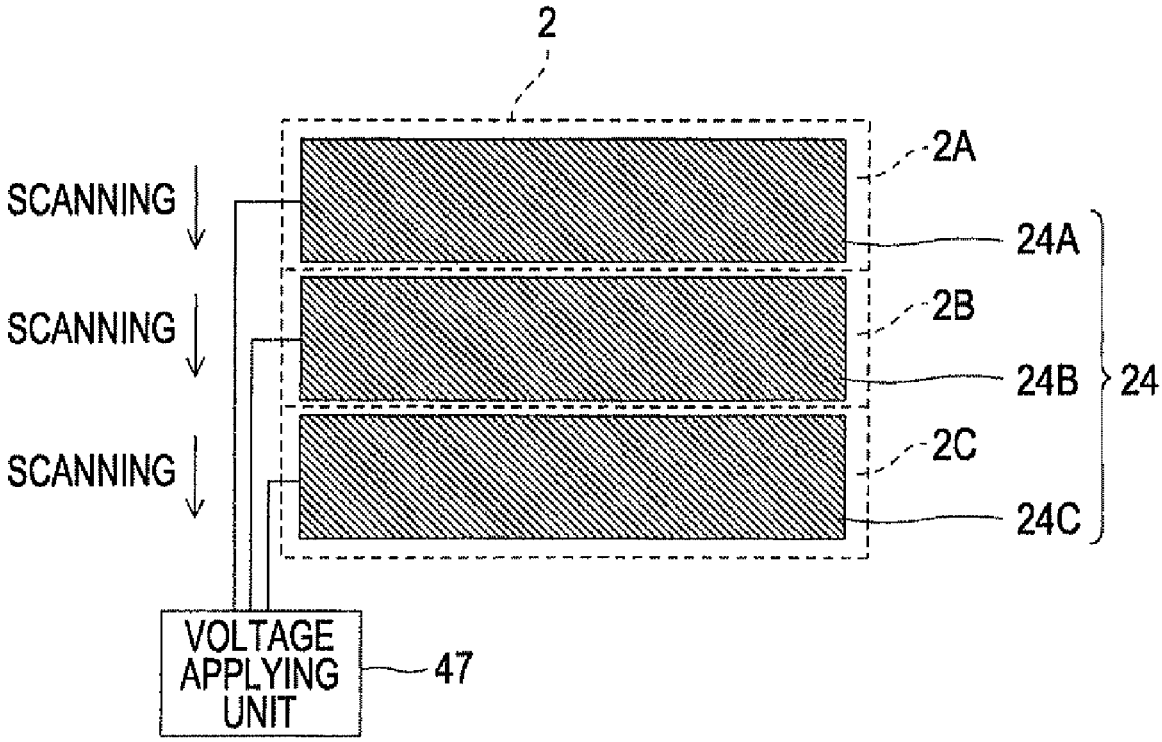
FIG. 4 is a plan view of a common electrode according to the embodiment of the invention.

FIG. 1 is a plan view of a liquid crystal display device according to an embodiment of the invention. FIG. 2 is a plan view of a display unit according to the embodiment of the invention. FIG. 3 is a cross-sectional view taken along line III-III of FIG. 2. FIG. 4 is a plan view of a common electrode according to the embodiment of the invention. First, the configuration of the liquid crystal display device 100 according to the embodiment of the invention will be described with reference to FIGS. 1 to 4.

As shown in FIG. 1, in the liquid crystal display device 100 according to the present embodiment, a display unit 2, a horizontal driving circuit 3 and a vertical driving circuit 4 are provided on a substrate 1 formed of glass. In this display unit 2, pixels 21 are arranged in a matrix. In FIG. 1, for simplification of the drawing, only four pixels 21 are shown. A driving IC 5 is provided at the outside of the substrate 1.

Data lines 6 and scanning lines 7 are connected to the horizontal driving circuit 3 and the vertical driving circuit 4, respectively, and the pixels 21 are arranged at positions where the data lines 6 and the scanning lines 7 intersect each other.

An image signal Video, a start signal STH, a scanning direction switching signal CSH, a clock signal CKH, an enable signal ENB, a positive potential VDD and a negative potential VBB are supplied from the driving IC 5 to the horizontal driving circuit 3. A start signal STV, an enable signal ENB, a scanning direction switching signal CSV, a clock signal CKV, a positive potential VDD and a negative potential VBB are supplied from the driving IC 5 to the vertical driving circuit 4. In the present embodiment, a clock stop signal CKVSTOP for stopping the generation of the clock signal CKV is supplied from the driving IC 5 to the vertical driving circuit 4. In addition, the driving IC 5 and the vertical driving circuit 4 are an example of a "driving control unit" of the invention.

Each of the pixels 21 includes an n-channel transistor 22 (hereinafter, referred to as a transistor 22), a pixel electrode 23, a common electrode 24 facing the pixel electrode 23, liquid crystal 25 sandwiched between the pixel electrode 23 and the common electrode 24, and an auxiliary capacitance 26. The source 22S of the transistor 22 is connected to one electrode of the pixel electrode 23 and the auxiliary capacitance 26 and the drain 22D thereof is connected to each of the data lines 6. The gate of the transistor 22 is connected to each of the scanning lines 7. The other electrode of the auxiliary capacitance 26 is connected to an auxiliary capacitive line 35 and the auxiliary capacitive line 35 is connected to an auxiliary capacitive line potential SC. The common electrode 24 is connected to a common electrode potential COM. The auxiliary capacitive line potential SC and the common electrode potential COM are supplied from the driving IC 5. The driving IC 5 is an example of a "voltage applying control unit" of the invention.

In the present embodiment, as shown in FIG. 2, the display unit 2 includes three display areas 2A, 2B and 2C arranged along a vertical scanning direction. The areas of the three display areas 2A, 2B and 2C may be equal to or different from each other. The three display areas 2A, 2B and 2C are independently scanned.

In the three display areas 2A, 2B and 2C, backlights 8A, 8B and 8C are provided, respectively. The backlights 8A, 8B and 8C are an example of a "light source" of the invention. In the present embodiment, the backlights 8A, 8B and 8C are independent and include backlights of red, green and blue, respectively. The backlights 8A, 8B and 8C are connected to a control circuit 9 and emit lights under the control of the control circuit 9.

As shown in FIG. 3, a polarization plate 31 is formed on a surface of the substrate 1 formed of glass. In addition, a semiconductor layer 32 and a semiconductor layer 33 are formed on a surface opposite to the surface of the substrate 1, on which the polarization plate 31 is formed. The semiconductor layer 32 is an active layer of the transistor 22 (see FIG. 1). The semiconductor layer 33 is a capacitive electrode configuring the auxiliary capacitance 26 connected to the transistor 22. A gate insulating film 34 is formed on the surfaces of the semiconductor layer 32 and the semiconductor layer 33. The scanning lines 7 functioning as a gate electrode are arranged on the surface of the gate insulating film 34 formed on the surface of the semiconductor layer 32. The auxiliary capacitive lines 35 for forming the auxiliary capacitances 26 are arranged on the surface of the gate insulating film 34 formed on the surface of the semiconductor layer 33.

A passivation film 36 is formed on the surfaces of the gate insulating film 34, the scanning lines 7 and the auxiliary capacitive lines 35. In addition, the data lines 6 and electrodes 37 are arranged on the surface of the passivation film 36. In addition, each of the data lines 6 is connected to a drain region 32D of the semiconductor layer 32 via a contact hole 38. In addition, each of the electrodes 37 is connected to a source region 32S of the semiconductor layer 32 via a contact hole 39, and is connected to the semiconductor layer 33 via a contact hole 40. A planarization film 41 is formed on the surfaces of the passivation film 36, the electrodes 37 and the data lines 6. The pixel electrodes 23 formed of a transparent electrode such as indium tin oxide (ITO) are formed on the surface of the planarization film 41. Each of the pixel electrodes 23 is connected to each of the electrodes 37 via a contact hole 42. In addition, an alignment film 43 is formed on the surface of the pixel electrodes 23.

A substrate 44 is provided so as to face the substrate 1. A polarization plate 45 is formed on the surface opposite to the surface of the substrate 44 which faces the substrate 1. The common electrode 24 formed of a transparent electrode such as ITO is formed on the surface opposite to the surface of the substrate 44 which faces the substrate 1. In the present embodiment, as shown in FIG. 4, the common electrode 24 includes common electrodes 24A, 24B and 24C so as to respectively correspond to the display areas 2A, 2B and 2C of the display unit 2. The common electrodes 24A, 24B and 24C are electrically separated. As shown in FIG. 3, an alignment film 46 is formed on the surface of the common electrode 24.

The liquid crystal 25 is sandwiched between the alignment film 43 of the substrate 1 and the alignment film 46 of the substrate 44. In the present embodiment, the liquid crystal 25 is OCB liquid crystal which is changed from spray alignment of an initial state to bend alignment by applying a voltage. A voltage applying unit 47 for applying a voltage $V_B$ is connected to the common electrode 24, in order to prevent the phase transition to the spray alignment after the phase transition of the liquid crystal 25 from the spray alignment to the bend alignment and perform a black display. The voltage $V_B$ is an example of a "predetermined voltage" of the invention. The backlights 8 (8A, 8B and 8C) are provided to face the substrate 1.

Figure 5:
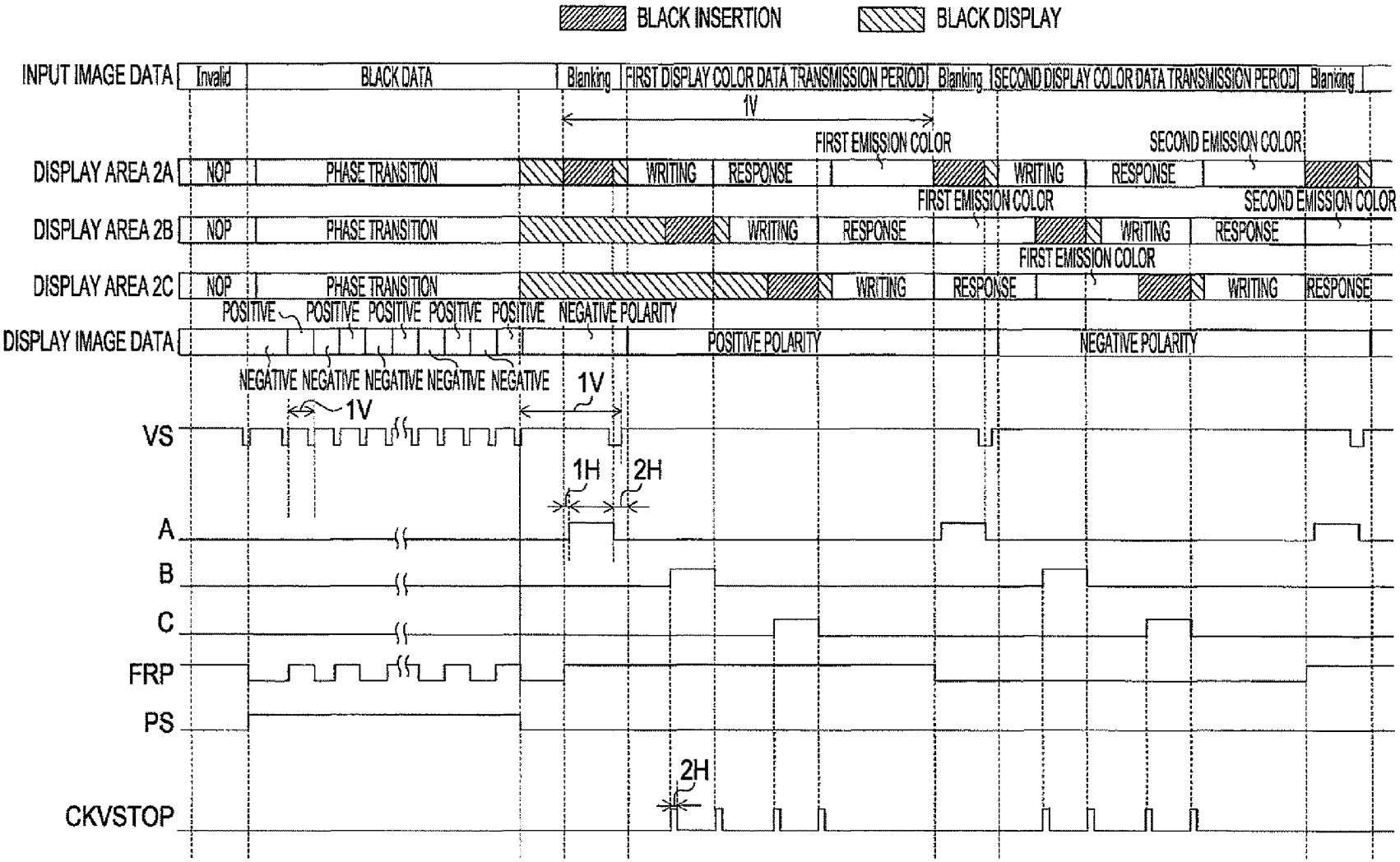
FIG. 5 is a view explaining the driving of the liquid crystal display device according to the embodiment of the invention.
Figure 6:
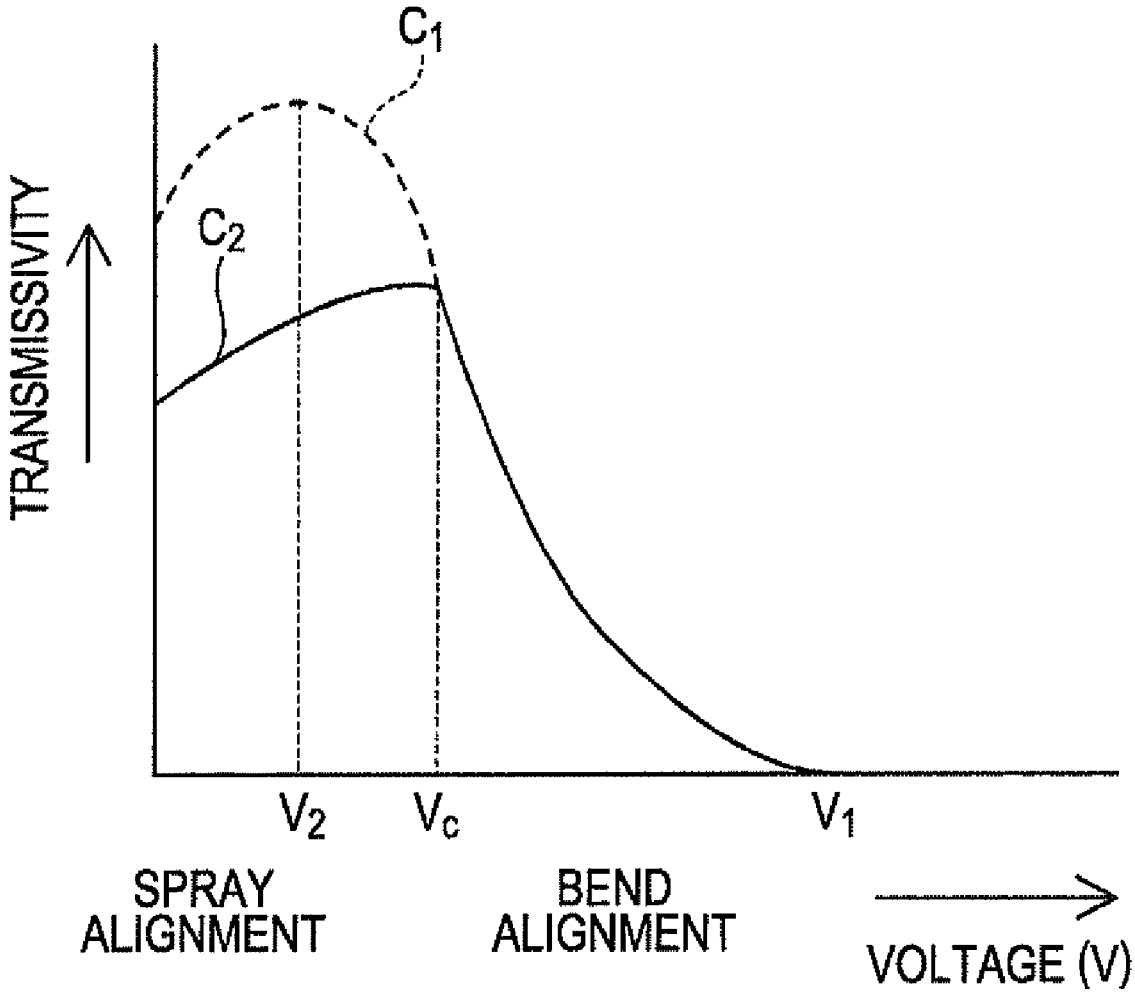
FIG. 6 is a view showing a relationship between transmissivity and a voltage applied to liquid crystal according to the embodiment of the invention.
Figure 7:
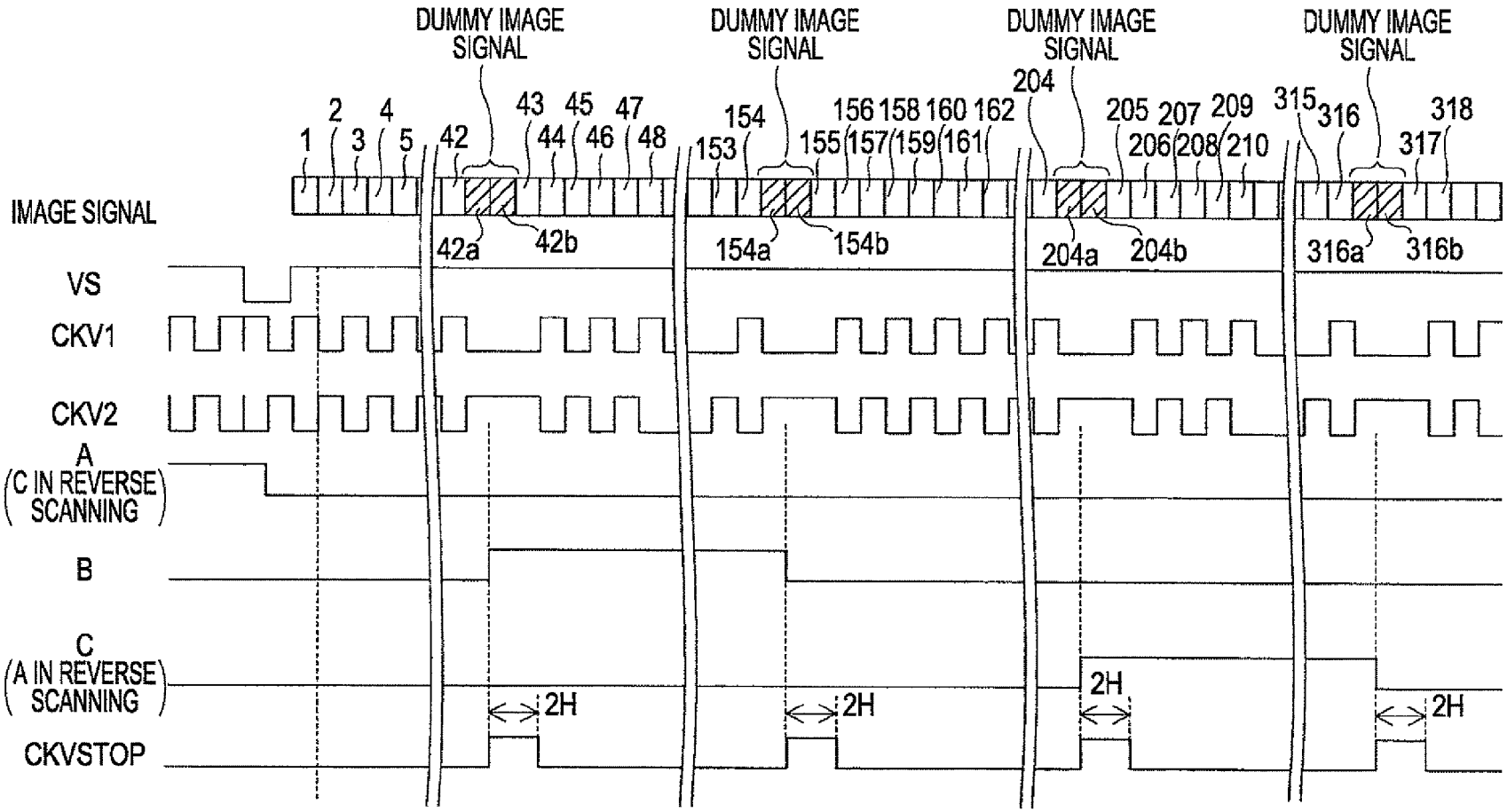
FIG. 7 is a view explaining the writing of an image signal according to the embodiment of the invention.

FIG. 5 is a view explaining the driving of the liquid crystal display device according to the embodiment of the invention. FIG. 6 is a view showing a relationship between transmissivity and the voltage applied to the liquid crystal according to the embodiment of the invention. FIG. 7 is a view explaining the writing of an image signal according to the embodiment of the invention. Next, the operation of the liquid crystal display device 100 according to the embodiment of the invention will be described with reference to FIGS. 5 to 7.

First, as shown in FIG. 5, after a power source is turned on, a phase transition control signal PS may rise to a Hi level. Accordingly, black data is written to the display areas 2A, 2B and 2C during a period PS=Hi. When the phase transition control signal PS rises to the Hi level, the phase transition of the liquid crystal 25 from the spray alignment to the bend alignment is finished. A FRP is a signal for inverting the polarity earlier than the vertical synchronization signal by a black insertion period, and a black insertion voltage is applied to the display areas 2A, 2B and 2C in correspondence with the polarity.

Black insertion is performed in the display area 2A and black display is held in the display areas 2B and 2C.

Next, after the signal FRP rises to the Hi level and one horizontal scanning period (1H) is then elapsed, a signal A may rise to the Hi level, and a voltage VB+ (or VB−) is applied to the common electrode 24 of the pixel 21 and/or a voltage VB− (or VB+) is applied to the auxiliary capacitive line 35, by the voltage applying unit 47. The signal A, a signal B and a signal C are input to the display areas 2A, 2B and 2C by the control circuit 9 shown in FIG. 2, respectively. By increasing a potential difference between the pixel electrode 23 and the common electrode 24, a potential difference between the pixel electrode 23 and the auxiliary capacitive line 35 or a potential difference between the common electrode 24 and the auxiliary capacitive line 35, black insertion having a voltage higher than a voltage (for example, about 5 V to 7 V) corresponding to the black data display is performed. The applying of the voltage VB+ (or VB−) prevents the phase transition of the liquid crystal 25 from the spray alignment to the bend alignment and the phase transition to the spray alignment and, as shown in FIG. 6, improves transmissivity in a voltage (about 1 V to 1.5 V) lower than a threshold voltage Vc (for example, about 2.3 V) for the phase transition from the spray alignment to the bend alignment in the case where the black insertion is not performed. In this case, for example, a voltage of about 6.9 V is applied to the common electrode 24 and the auxiliary capacitive line 35 at the time of the display, and a voltage of about 13.8 V (0 V) is applied to the common electrode 24, or a voltage of 0 V (or 13.8 V) is applied to the auxiliary capacitive line 35, or these voltages are simultaneously applied at the time of the black insertion.

By applying the voltage VB+ (or VB−) to the common electrode 24, as denoted by a dotted line $C_1$ of FIG. 6, it is possible to improve transmissivity although a voltage $V_2$ corresponding to a white display is applied to the liquid crystal 25 in a writing period. If the voltage VB+ (or VB−) is not applied to the common electrode 24, as denoted by a solid line $C_2$ of FIG. 6, transmissivity deteriorates when the voltage $V_2$ corresponding to the white display is applied to the liquid crystal 25 in the writing period.

As shown in FIG. 5, while the black insertion is performed in the display area 2A, the vertical synchronization signal VS having a negative polarity is generated, input image data transitions from invalid data Invalid of a Blanking period to a display data transmission period, and an image signal of red corresponding to a first display color is transmitted to the data line 6.

In the display area 2A, the signal A may fall before two horizontal scanning periods (2H) of a time point when the black display is finished. After 2H is elapsed, an image signal is written to the pixels 21 of the display area 2A. At this time, the signal FRP has the Hi level and image data having a positive polarity is written as display image data.

In addition, in parallel to the writing period of the display area 2A, in the display area 2B, the signal B rises to the Hi level such that the voltage VB+ (or VB−) is applied to the common electrode 24B of the display area 2B and/or the voltage VB− (or VB+) is applied to the auxiliary capacitive line 35. Accordingly, in the display area 2B, the black insertion is performed similar to the above-described display area 2A. In the present embodiment, as shown in FIG. 7, the clock stop signal CKVSTOP may rise to the Hi level during the two horizontal scanning periods (2H) after the signal B rises to the Hi level. Accordingly, in the present embodiment, in the vertical driving circuit 4, the generation of a clock signal CKV1 and a clock signal CKV2 having a polarity inverted from the polarity of the clock signal CKV1 is stopped. The two horizontal scanning periods in which the generation of the clock signal CKV1 and the clock signal CKV2 is stopped is an example of a "predetermined period" of the invention. As the result of stopping the generation of the clock signal CKV1 and the clock signal CKV2, in the display area 2A, vertical scanning is stopped and the writing of the image signal to the pixel electrode 23 of the pixel 21 is stopped. In the present embodiment, in the two horizontal scanning periods in which the generation of the clock signals CKV1 and CKV2 is stopped, dummy image signals (two image signals 42*a* and 42*b* denoted by oblique lines in FIG. 7) are transmitted to the data line 6 as the image signal. Since the clock signals CKV1 and CKV2 are stopped in the two horizontal scanning periods, vertical scanning is stopped and, at this time, the image signals 42*a* and 42*b* are not written to the pixel 21. As the dummy image signals, any data may be used. For example, white display data, black display data and data of the image signal 42 which is written just before may be consecutively sent. When data which is desired to be next written, that is, the image signal 43, is consecutively sent, the data line 6 can be precharged After the recording to the display area 2A is finished or before the black insertion of the display area 2B is finished after a predetermined period is elapsed, the signal B falls to a Low level such that the applying of the voltage VB+ (or VB−) to the common electrode 24B of the display area 2B and/or the applying of the voltage VB− (or VB+) to the auxiliary capacitive line 35 is finished. In the present embodiment, the clock stop signal CKVSTOP may rise to the Hi level during the two horizontal scanning periods after the signal B falls to the Low level. Accordingly, in the present embodiment, in the two horizontal scanning periods in which the generation of the clock signals CKV1 and CKV2 is stopped, dummy image signals (two image signals 154*a* and 154*b* denoted by oblique lines in FIG. 7) are transmitted to the data line 6 as the image signals. However, since the clock signals CKV1 and CKV2 are stopped, the scanning is stopped and, at this time, the image signals 154*a* and 154*b* are not written to the pixel 21.

Thereafter, the writing of the image signals to the pixel 21 of the display area 2A is finished, a response period of the liquid crystal 25 is passed, and the backlight 8 of red corresponding to the first display color emits light. In the display area 2B, after the black insertion, the writing of the image signal of red corresponding to the first display color to the pixel 21 is started after the two horizontal scanning periods in which the generation of the clock signals CKV1 and CKV2 is stopped is elapsed.

Similarly, in parallel to the writing period of the display area 2B, in the display area 2C, the signal C rises to the Hi level such that the voltage VB+ (or VB−) is applied to the common electrode 24C of the display area 2C and/or the voltage VB− (or VB+) is applied to the auxiliary capacitive line 35. Accordingly, the black insertion is performed in the display area 2C. In the present embodiment, as shown in FIG. 7, the clock stop signal CKVSTOP may rise to the Hi level during the two horizontal scanning periods (2H) after the signal C rises to the Hi level. Accordingly, in the present embodiment, the generation of the clock signal CKV1 and the clock signal CKV2 is stopped. As a result, in the display area 2B, the writing of the image signals to the pixel 21 is stopped. In the present embodiment, in the two horizontal scanning periods in which the generation of the clock signals CKV1 and CKV2 is stopped, dummy image signals (two image signals 204*a* and 204*b* denoted by oblique lines in FIG. 7) are transmitted to the data line 6 as the image signals. However, since the clock signals CKV1 and CKV2 are stopped, the scanning is stopped and, at this time, the image signals 204*a* and 204*b* are not written to the pixel 21.

Before the black insertion of the display area 2C is finished, the signal C falls to the Low level such that the applying of the voltage VB+ (or VB−) to the common electrode 24C of the display area 2C and/or the applying of the voltage VB− (or VB+) to the auxiliary capacitive line 35 is finished. In the present embodiment, the clock stop signal CKVSTOP may rise to the Hi level during the two horizontal scanning periods after the signal C falls to the Low level. Accordingly, in the present embodiment, the generation of the clock signal CKV1 and the clock signal CKV2 is stopped. As a result, in the display area 2B, the writing of the image signals to the pixel 21 is stopped. In the present embodiment, in the two horizontal scanning periods in which the generation of the clock signals CKV1 and CKV2 is stopped, dummy image signals (two image signals 316*a* and 316*b* denoted by oblique lines in FIG. 7) are transmitted to the data line 6 as the image signals. However, since the clock signals CKV1 and CKV2 are stopped, the scanning is stopped and, at this time, the image signals 316*a* and 316*b* are not written to the pixel 21.

Thereafter, the writing of the image signals to the pixel 21 of the display area 2B is finished, a response period of the liquid crystal 25 is passed, and the backlight 8 of red corresponding to the first display color emits light. In the display area 2C, after the black insertion period is elapsed, the writing of the image signal of red corresponding to the first display color to the pixel 21 is started.

As shown in FIG. 5, input image data corresponding to the first display color is finished and transitions to the Blanking period. Thereafter, the recording of the display pixel data to the pixel is finished with the delay of one horizontal scanning period. The light emission of the backlight 8 of red corresponding to the first display color in the display area 2A, the response period of the pixel 21 in the display area 2B, and the writing of the image signal to the pixel 21 in the display area 2C are substantially simultaneously finished. The black insertion is started in the display area 2A, the light emission of the backlight 8 of red corresponding to the first display color is started in the display area 2B, and the response period of the liquid crystal 25 is started in the display area 2C. At this time, the signal FRP falls to the Low level. By repeating the above-described operation, the writing of the input image data of green corresponding to a second display color and the light emission of the backlight 8 of green corresponding to the second display color are performed in a next field while timings are delayed in the display area 2A, 2B and 2C, and the writing of the input image data of blue corresponding to a third display color and the light emission of the backlight 8 of blue corresponding to the third display color are sequentially performed in a next field, thereby performing the field sequential driving. At the time of the start and the end of the black insertion of the display area 2A, the clock stop signal CKVSTOP is not generated. This is because the writing of the image signal to the pixel 21 does not need to be stopped since the black insertion period of the display area 2A corresponds to the Blanking period and the input image data is not written to the pixel 21.

In the present embodiment, as described above, since the display unit 2 includes the plurality of display areas 2A, 2B and 2C, unlike the case where the backlights 8 emit lights after the display image data is written to all the pixels 21 of the display area 2A, 23 and 2C, since the backlights 8A, 8B and 8C emit lights at time points when the writing of the display image data to the pixels 21 of the display area 2A, 2B and 2C is finished and the response period of the liquid crystal is finished, the writing of the display image data to all the pixels 21 of the display unit 2 may not be awaited and thus the liquid crystal display device 100 can be operated at a high speed. By applying the voltage VB+ (or VB−) to the common electrode 24 of the pixel 21 and applying the voltage VB− (or VB+) (a high voltage equal to or greater than the black display by the pixel 21) to the auxiliary capacitive line 35, it is possible to perform the black display in the pixel 21. Accordingly, since the black display (black insertion) can be performed between the image which is previously displayed and the image which is newly displayed, it is possible to suppress the blurring of a moving image or the like. By stopping the writing of the image signal to the pixel 21 during two horizontal scanning periods after the start time point and the end time point of the applying of the voltage VB+ (or VB−) to the common electrode 24 of the pixel 21 and/or the applying of the voltage VB− (or VB+) to the auxiliary capacitive line 35, although capacitive coupling due to the voltage VB+ (or VB−) between the data line 6 and the common electrode 24 and/or the voltage VB− (or VB+) to the auxiliary capacitive line 35 is generated, a potential variation of the data line 6 due to the capacitive coupling during the two horizontal scanning periods in which the writing of the image signal from the data line 6 to the pixel 21 is stopped is recovered. Accordingly, it is possible to prevent a distorted image signal from being written from the data line 6 to the pixel 21 and suppress the deterioration of the quality of the displayed image.

In the present embodiment, as described above, since the stop of the writing of the image signal to the pixel 21 in the two horizontal scanning periods is performed after both the start time point and the end time point of the applying of the voltage VB+ (or VB−), it is possible to further suppress the writing of the distorted image signal from the data line 6 to the pixel 21, compared with the case where the stop of the writing of the image signal to the pixel 21 in the two horizontal scanning periods is performed after only one of the start time point or the end time point of the applying of the voltage VB+ (or VB−).

In the present embodiment, as described above, since the predetermined period in which the writing of the image signal is stopped is the two horizontal scanning period in which the pixel 21 is scanned, it is possible to reduce the potential variation of the data line 6 due to the capacitive coupling due to the voltage VB+ (or VB−) generated between the data line 6 and the common electrode 24 and/or the data line 6 and the auxiliary capacitive line 35 with certainty.

In the present embodiment, as described above, since the image signal is written to the plurality of pixels 21 on the basis of the clock signal CKV and the generation of the clock signal is stopped in the two horizontal scanning periods, it is possible to easily suppress the writing of the image signal to the pixels during the two horizontal scanning periods.

In the present embodiment, as described above, by including the clock stop signal CKVSTOP for stopping the writing of the image signal by the clock signal CKV, it is possible to easily stop the generation of the clock signal CKV.

In the present embodiment, as described above, as the liquid crystal 25, by utilizing the OCB liquid crystal which becomes the bend alignment in which the constituent molecules are arranged in a bow form after a phase transition voltage is applied, since the variation of the alignment of the liquid crystal molecules are accelerated by the bending of the bow, it is possible to configure the liquid crystal display device 100 with a high response speed.

In the present embodiment, as described above, by respectively configuring the first display color, the second display color and the third display color of the backlight 8 by the backlight 8 which emits the lights of red, green and blue, it is possible to easily display a color image by additive color mixture of lights of red, green and blue. In the case of the additive color mixture, since the display is completed by a mixed color of two or more of the first display color, the second display color and the third display color, a display time difference between the respective colors is generated. Accordingly, in particular, in a moving image, color break in which a contour is changed according to the colors is generated and thus display quality deteriorates. Therefore, although a display color is reduced, when the first display color, the second display color and the third display color are respectively red, green and yellow, it is possible to realize a display without color break of three-color gradation. In addition, when the first display color, the second display color, the third display color and a fourth display color are respectively red, green, yellow and orange, it is possible to realize a display without color break of four-color gradation.

In the present embodiment, as described above, although the example in which the light sources having the display colors time-divisionally emit lights is described as the field sequential example, the invention is not limited to this, and a configuration in which light sources having a plurality of colors simultaneously emit lights may be employed.

In the present embodiment, as described above, since the display unit 2 is configured by the three display areas 2A, 2B and 2C such that the backlights 8A, 8B and 8C emit lights after the writing of the image signals in the three display areas 2A, 2B and 2C, the writing of the image signals to all the pixels 21 of the display unit 2 may not be awaited, unlike the case where the backlight 8 emits light after the image signals are written to all the pixels 21 of the display unit 2. Therefore, the liquid crystal display device 100 can be operated at a high speed.

In the present embodiment, as described above, since the common electrodes 24 of the pixels 21 are respectively provided in the plurality of display areas 2A, 2B and 2C such that the voltage VB+ (or VB−) is applied to each of the common electrodes 24A, 24B and 24C in the display areas 2A, 2B and 2C, it is possible to perform the black display in each of the display area 2A, 2B and 2C.

The disclosed embodiment has only been given by way of example for explanation of the invention and the range of the invention is not to be considered as being limited by the details of this embodiment. The range of the invention is expressed by claims instead of the description of the above embodiment, and all modifications are included in the claims and equivalent thereof.

For example, although, in the above-described embodiment, the example in which the writing to the pixel is stopped after both the start time point and the end time point of the applying of the voltage VB+ (or VB−) is described, the invention is not limited to this and the writing to the pixel may be stopped after the start time point or the end time point of the applying of the voltage VB+ (or VB−).

Although, in the above-described embodiment, the example in which the writing to the pixel is stopped after the start and the end of the applying of the voltage VB+ (or VB−) is described, the invention is not limited to this, and the writing to the pixel may be stopped before the start or the end of the applying of the voltage VB+ (or VB−) if it is close to the start time point or the end time point of the applying of the voltage VB+ (or VB−).

Although, in the above-described embodiment, the example in which the writing of the image signal is stopped between the two horizontal scanning periods is described, the invention is not limited to this, and the writing of the image signal may be stopped at a time when the distortion of the image signal can be at least solved.

Although, in the above-described embodiment, the example of dividing the display unit into three display areas is described, the invention is not limited to this, and the display unit may be divided into two display areas or four or more display areas.

Although, in the above-described embodiment, the example of stopping the writing of the input image data by the clock stop signal is described, the invention is not limited to this, and the writing of the image signal may be stopped using a signal other than the clock stop signal.

Although, in the above-described embodiment, the example of using the backlights of three colors of red, green and blue is described, the invention is not limited to this, and backlights of two colors or four or more colors may be used.

The entire disclosure of Japanese Patent Application No. 2008-120866, filed May 7, 2008 are expressly incorporated by reference herein.

What is claimed is:

1. An electro-optical device comprising:

a display unit including a plurality of display areas in which pixels are arranged;

common electrodes provided in correspondence with the plurality of display areas;

pixel electrodes provided in correspondence with the pixels and facing the common electrodes with an electro-optical material interposed therebetween;

a driving control unit which controls writing of an image signal to the pixel electrode in each of the plurality of display areas; and a voltage applying control unit which controls applying of a predetermined voltage to the common electrode in each of the plurality of display areas;

wherein the driving control unit is configured to stop the writing of the image signal to the pixel electrode during a predetermined period in a period close to at least one of a start time point or an end time point of the applying of the predetermined voltage, when the predetermined voltage is applied to the common electrode of the display area adjacent to one display area by the voltage applying control unit during a period in which the image signal is written to the pixel electrode in one of the plurality of display areas.

2. The electro-optical device according to claim 1, further comprising auxiliary capacitive electrodes provided in the pixel electrodes, wherein the driving control unit is configured to apply the predetermined voltage to the common electrode of the display area and to apply the predetermined voltage to the auxiliary capacitive line.

3. The electro-optical device according to claim 1, wherein the stop of the writing of the image signal to the pixel electrode during the predetermined period is performed in periods close to both the start time point and the end time point of the applying of the predetermined voltage.

4. The electro-optical device according to claim 1, wherein:

in the display area, the pixels are arranged in a matrix, and the predetermined period is a period equal to or greater than at least two horizontal scanning periods in which the pixels arranged in the matrix are scanned.

5. The electro-optical device according to claim 1, wherein, in one of the plurality of display areas, black display is performed in the pixel by applying the predetermined voltage to at least one of the common electrode or the auxiliary capacitive line and, in the display area adjacent to one display area in which the black display is performed, the writing of the image signal to the pixel electrode is stopped during the predetermined period in the period close to at least one of the start time point or the end time point of the black display.

6. The electro-optical device according to claim 1, wherein the driving control unit writes the image signal to the pixel electrode on the basis of a clock signal and stops the clock signal to the driving control unit in the predetermined period.

7. The electro-optical device according to claim 1, wherein a dummy image signal is supplied to a data line in the predetermined period in which the writing of the image signal is stopped.

8. The electro-optical device according to claim 1, wherein the electro-optical material is liquid crystal, and is driven by a liquid crystal mode which becomes bend alignment in which constituent molecules are arranged in a bow form, after a phase transition voltage is applied to the liquid crystal.

9. The electro-optical device according to claim 1, wherein the plurality of display areas respectively include light sources which time-divisionally emit lights of three colors of red, green and blue, three colors of red, green and yellow, or four colors of red, green, yellow and orange.

10. The electro-optical device according to claim 1, wherein the plurality of display areas include three or more display areas.

11. An electro-optical device comprising:

a display unit including a plurality of display areas in which pixels are arranged;

common electrodes provided in correspondence with the plurality of display areas;

pixel electrodes provided in correspondence with the pixels and facing the common electrodes with an electro-optical material interposed therebetween;

auxiliary capacitive electrodes provided in correspondence with the pixel electrodes;

a driving control unit which controls writing of an image signal to the pixel electrode in each of the plurality of display areas; and a voltage applying control unit which controls applying of a predetermined voltage to the auxiliary capacitive electrode in each of the plurality of display areas;

wherein the driving control unit is configured to stop the writing of the image signal to the pixel electrode during a predetermined period in a period close to at least one of a start time point or an end time point of the applying of the predetermined voltage, when the predetermined voltage is applied to the auxiliary capacitive electrode of the display area adjacent to one display area by the voltage applying control unit during a period in which the image signal is written to the pixel electrode in one of the plurality of display areas.

* * * * *